US009962970B2

(12) United States Patent
Ohnishi

(10) Patent No.: US 9,962,970 B2
(45) Date of Patent: May 8, 2018

(54) PRINTER

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/321,751

(22) PCT Filed: Jun. 24, 2015

(86) PCT No.: PCT/JP2015/068121
§ 371 (c)(1),
(2) Date: Dec. 23, 2016

(87) PCT Pub. No.: WO2015/199107
PCT Pub. Date: Dec. 30, 2015

(65) Prior Publication Data

US 2017/0129263 A1 May 11, 2017

(30) Foreign Application Priority Data

Jun. 24, 2014 (JP) ..... 2014-129555

(51) Int. Cl.
*B41J 15/16* (2006.01)
*B65H 23/26* (2006.01)

(52) U.S. Cl.
CPC ..... *B41J 15/16* (2013.01); *B65H 23/26* (2013.01)

(58) Field of Classification Search
CPC ..... B41J 15/165; B65H 23/035; B65H 23/038
See application file for complete search history.

(56) References Cited

U.S. PATENT DOCUMENTS 1,794,094 A * 2/1931 Smith ..... B41J 15/02 400/615
2,655,252 A * 10/1953 Spurgeon ..... B65G 39/16 198/806

(Continued)

FOREIGN PATENT DOCUMENTS

JP S54-066385 5/1979
JP S60-044440 3/1985

(Continued)

OTHER PUBLICATIONS

"International Search Report (Form PCT/ISA/210) of PCT/JP2015/068121", dated Sep. 8, 2015, with English translation thereof, pp. 1-4.

*Primary Examiner* — Shelby Fidler
(74) *Attorney, Agent, or Firm* — JCIPRNET

(57) ABSTRACT

A printer is provided with: a feed roller on which an elongated shaped medium is wound in a roll form and from which the medium is unwound and fed in a predetermined transport direction; a printing unit that prints an object to be printed on the medium fed from the feed roller; a take-up roller that takes up the medium printed by the printing unit in a roll form; and a tension applying member that applies a tension to the medium by making a contact with a surface opposite to a print surface of the medium. The tension applying member has a support portion disposed at a center position in a width direction of the medium, and an oscillation shaft extending in the width direction of the medium and adapted to oscillate in contact with the medium. The oscillation shaft is oscillated on the support portion serving as fulcrum.

5 Claims, 4 Drawing Sheets

(56) References Cited

U.S. PATENT DOCUMENTS

| | | | | |
|---|---|---|---|---|
| 4,744,680 | A * | 5/1988 | Hirosaki | B41J 17/02 347/216 |
| 5,276,460 | A * | 1/1994 | Miyajima | B41J 2/005 226/15 |
| 6,676,066 | B2 | 1/2004 | Keel | |
| 7,267,255 | B1 * | 9/2007 | Young | G03G 15/1685 226/15 |
| 8,360,233 | B2 * | 1/2013 | Eriksson | B65G 39/16 198/806 |
| 2003/0047580 | A1 * | 3/2003 | Harris | B65H 23/038 226/21 |
| 2008/0128545 | A1 * | 6/2008 | Midorikawa | B41J 15/04 242/596 |
| 2013/0016368 | A1 * | 1/2013 | Bouverie | B41J 11/009 358/1.6 |
| 2016/0167408 | A1 * | 6/2016 | Sasaki | B41J 15/04 347/16 |

FOREIGN PATENT DOCUMENTS

| | | |
|---|---|---|
| JP | 2010247916 | 11/2010 |
| JP | 2012106854 | 6/2012 |

* cited by examiner

PRINTER

CROSS-REFERENCE TO RELATED APPLICATION

This application is a 371 application of International PCT application serial no. PCT/JP2015/068121, filed on Jun. 24, 2015, which claims the priority benefit of Japan application no. 2014-129555, filed on Jun. 24, 2014. The entirety of each of the abovementioned patent applications is hereby incorporated by reference herein and made a part of this specification.

TECHNICAL FIELD

This invention relates to a printer to print, for example, characters and/or figures on an elongated media.

BACKGROUND ART

Conventionally, there are known printers adapted for use with elongated media that is wound in a roll form. In the printers of this type, a rolled medium is sequentially unwound from a feed roller and fed in a predetermined transport direction, and a print object is printed on a surface to be printed of the medium. Then, the printing-completed medium is collected by a take-up roller.

In such printers, however, skew such as meandering and/or kinking of the medium may be likely to occur during the transport of the medium, for example. The skew imposes stress on the medium, further developing other issues, such as the medium being lifted and/or failing to be transported with precision, and a poor balance between image qualities on two lateral sides of the surface to be printed. To deal with these issues, printers have been proposed that are equipped with members for holding the roll core of the rolled medium. Such a member is more specifically a medium holder structured to incline the axis of the roll core correspondingly to a difference, if any, between tensions generated on the medium on one axial end side and the other axial end side of the roll core (for example, patent literature 1).

CITATION LIST

Patent Literature

Patent Literature 1: Japanese Unexamined Patent Publication No. 2010-247916

SUMMARY OF INVENTION

Technical Problems

Conventionally, the feed roller and the take-up roller are very heavy because the medium is tightly wound around these rollers. When the medium holders are attached to the feed roller and the take-up roller, and axes of these rollers are inclined (oscillated) as in the known printers, such heavy rollers may often be poorly responsive when requested to incline their axes. Thus, the known printers have difficulty in delivering effective solutions to the occurrence of skew and/or medium lifting.

The present invention was accomplished to solve these issues and is directed to providing a printer that may deliver effective solutions to the occurrence of skew and/or medium lifting and that may improve possible drawbacks during the transport of media.

Solutions to Problems

This invention provides a printer including: a feed roller on which a medium with an elongated shape is wound in a roll form and from which the medium is unwound and fed in a predetermined transport direction; a printing unit that prints an object to be printed on the medium fed from the feed roller; a take-up roller that takes up the medium printed by the printing unit in a roll form; and a tension applying member that applies a tension to the medium by making a contact with a surface opposite to a print surface of the medium. The tension applying member has a support portion disposed at a center position in a width direction of the medium, and an oscillation shaft extending in the width direction of the medium and adapted to oscillate in contact with the medium in a thickness direction of the medium, the oscillation shaft being oscillated on the support portion serving as fulcrum.

In the printer according to this invention, the tension applying member has the support portion at the center position in the width direction of the medium, and the oscillation shaft extending in the width direction of the medium and adapted to oscillate in contact with the medium in the thickness direction of the medium. The support portion serves as the oscillation fulcrum of the oscillation shaft. In case of any difference between tensions generated on one end side and the other end side in the width direction of the medium, the oscillation shaft oscillates in a direction in which the tension difference is negated. When, for example, skew is about to occur during the transport of the medium, the oscillation shaft immediately starts to oscillate, absorbing the difference between tensions generated on two lateral sides of the medium. As a result, the occurrence of skew and/or medium lifting may be effectively prevented. Such a simple structure may promise steady and reliable transport of the medium without the risk of the medium meandering from one side to the other. The medium thus transported and collected by the take-up roller may effectively reduce unfavorable events such as crinkling.

The tension applying member may be disposed at a position between the feed roller and the take-up roller. According to this aspect, the medium unwound and fed from the feed roller may be steadily and reliably collected by the take-up roller without the risk of the medium meandering from one side to the other, effectively reducing unfavorable events such as crinkling of the medium. The tension applying member is positioned in a relatively large space between the feed roller and the take-up roller. Therefore, the tension applying member may be disposed without disturbing the layout of the printer.

In another aspect, the printer may further include a medium position regulation guide that regulates the medium to locate at a predetermined position, and the support portion may be disposed on a straight line passing through the center position in the width direction of the medium regulated by the medium position regulation guide and extending in the transport direction of the medium. According to this aspect, the support portion serving as the oscillation fulcrum of the oscillation shaft is always positioned at the center in the width direction of the medium. This may adequately absorb a difference, if any, between tensions generated in the width direction of the medium, effectively preventing the occurrence of skew and/or medium lifting. In yet another aspect, the oscillation shaft may be disposed in vicinity of the medium position regulation guide. By thus having the oscillation shaft and the medium position regulation guide disposed in vicinity to each other, the occurrence of skew and/or medium lifting may be effectively prevented.

In yet another aspect, the oscillation shaft may be disposed at a position on a downstream side in the transport direction relative to the medium position regulation guide. According to this aspect, the medium regulated by the medium position regulation guide and thereby positionally corrected is then oscillated by the oscillation shaft. This may effectively prevent the occurrence of skew and/or medium lifting. In yet another aspect, the support portion may be movable in a direction orthogonal to the transport direction of the medium and located on a straight line extending in the transport direction. According to this aspect, the position of the support portion may be suitably changed in accordance with the center position in the width direction of the medium. In case media having different widths are transported, any one of the media may be readily and reliably collected by the take-up roller and thereby prevented from undergoing unfavorable events such as crinkling.

Advantageous Effect of the Invention

According to this invention, in case generated tensions differ between one end side and the other end side in the width direction of the medium, the oscillation shaft is oscillated in a direction in which the tension difference is negated. Hence, any difference between tensions generated on two lateral sides of the medium during the transport of the medium may be adequately absorbed, and the occurrence of skew and/or medium lifting may be thereby effectively prevented. Such a simple structure may promise steady and reliable transport of the medium without the risk of the medium meandering from one side to the other. The medium thus transported and collected by the take-up roller may effectively reduce unfavorable events such as crinkling.

DESCRIPTION OF EMBODIMENT

Figure 1:
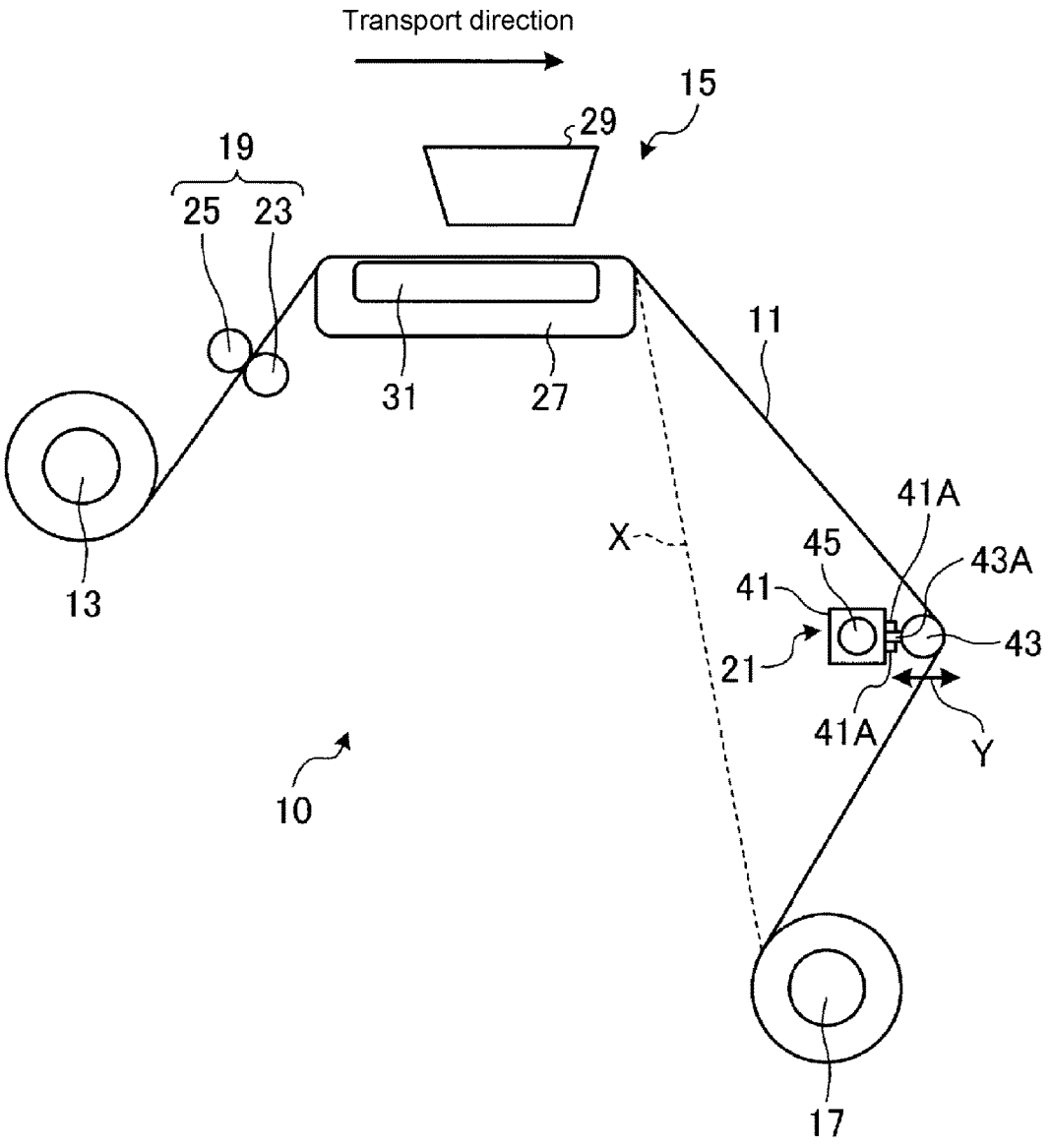
FIG. 1 is a schematic drawing of a printer according to an embodiment of this invention.

An embodiment of this invention is hereinafter described referring to the accompanying drawings. FIG. 1 is a schematic drawing of a printer 10 according to the embodiment. A printer 10 discharges liquid such as inks on a recording surface (surface to be printed) of an elongated shaped medium 11 to print, for example, characters and/or figures on the recording surface. Exemplified materials of the medium 11 may include fabrics, resin sheets (for example, vinyl chloride and polyester) and papers. This printer is an inkjet printer suitable for use in printing recording media variable in dimension under tensions.

As illustrated in FIG. 1, the printer 10 has a feed roller 13 on which the unprinted medium 11 is tightly wound in a roll form, a printing unit 15 that prints an object to be printed on the medium 11 unwound and fed from the feed roller 13, and a take-up roller 17 that takes up the medium 11 having the object printed thereon by the printing unit 15. The printer 10 further has medium transport rollers 19 and a tension applying member 21. The medium transport rollers 19 are disposed at positions between the feed roller 13 and the printing unit 15. The medium transport rollers 19 transport the medium 11 unwound and fed from the feed roller 13 while holding the medium 11 therebetween. The tension applying member 21 is disposed at a position between the printing unit 15 and the take-up roller 17 and applies a tension to the medium 11 by making a contact with the medium 11.

The feed roller 13 is inserted in the hollowed portion of the roll core of the rolled medium 11 (not illustrated in the drawings) to support the medium 11. The feed roller 13 is driven to rotate by, for example, the motive power of a motor. The feed roller 13, by rotating the rolled medium 11, unwinds and feeds the medium 11 as the transport of the medium 11 is prompted. One of the medium transport rollers 19 is a driving roller 23, and the other one is a driven roller 25. The driving roller 23 is rotated by the motive power of a motor. The driven roller 25 is disposed opposite to the driving roller 23 with the medium 11 held therebetween. By rotating the driving roller 23, the medium 11 held between the driving roller 23 and the driven roller 25 is transported in a predetermined transport direction.

The printing unit 15 has a platen 27 that supports the medium 11 transported by the medium transport rollers 19, and a printing head 29 spaced at a predetermined interval from the medium 11 supported by the platen 27. The printing head 29 has a plurality of ink injection nozzles on a surface thereof facing the medium 11. The printing head 29 is loaded in a carriage (not illustrated in the drawings). The carriage is supported at a vertically upward position above the platen 27 and is allowed to move in the width direction of the medium 11. The printing head 29, while moving with the carriage above the medium 11, injects predetermined inks through the nozzles to print an object to be printed on the medium 11. In this embodiment, the platen 27 has a medium position regulation guide 31. The medium position regulation guide 31 guides the medium 11 being transported and regulates the center position in the width direction of the medium 11 to coincide with a predetermined position. This may suppress that the medium 11 on the platen 27, while being transported, deviates from the predetermined center position, conducing to an improved quality of the printing operation by the printing unit 15.

The take-up roller 17 is driven to rotate by the motive power of the motor to take up the printing-completed medium 11 in a roll form. The hollowed portion of a roll core (not illustrated in the drawings) is inserted with the take-up roller 17. The take-up roller 17 rotates with the roll core as the medium 11 is transported, and the medium 11 is wound around the roll core. The take-up roller 17 has a tension bar extending in the width direction of the medium 11, and a tension mechanism (not illustrated in the drawings) including a pair of right and left arms that can oscillate the tension bar upward and downward. The tension mechanism applies a certain degree of tension to the medium 11 by having the tension bar oscillate downward under its own weight depending on looseness of the medium 11 between the take-up roller 17 and the medium transport rollers 19.

In the printer 10 thus structured, however, skew such as meandering and/or kinking of the medium may be likely to occur during the transport of the medium 11, for example. The occurrence of skew may cause the medium 11 to lean to one end side of the take-up roller 17 or to meander in the width direction as the medium 11 is collected by the take-up roller 17. As a result of such failure to collect the medium 11 with precision, the collected medium 11 may possibly be crinkled, for example.

Figure 2:
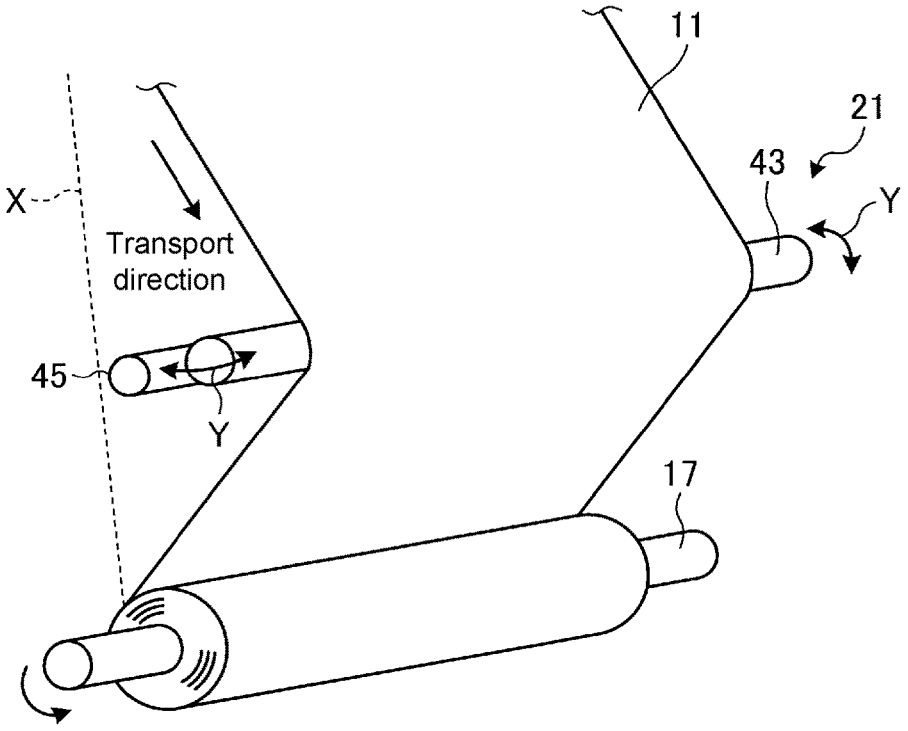
FIG. 2 is a partial perspective view of a medium subject to a tension applied by a tension applying member according to the embodiment.

To avoid the unfavorable event, this embodiment, as illustrated in FIG. 1, provides the tension applying member 21 between the printing unit 15 and the take-up roller 17. The tension applying member 21 applies a tension to the medium 11 by making a contact with the medium 11. FIG. 2 is a partial perspective view of the medium subject to the tension applied by the tension applying member according to this embodiment. As illustrated in FIGS. 1 and 2, the tension applying member 21 serves to absorb a difference, if any, between tensions generated on one end side and the other end side in the width direction of the medium 11. The tension applying member 21 is disposed on the outer side than a broken line X connecting the platen 27 and the take-up roller 17. Further, the tension applying member 21 extends in the width direction of the medium 11 and contacts a surface on the inner side of the medium 11. The outer side described herein refers to a side closer to the print surface of the medium 11. The inner side of the medium 11 described herein refers to a side closer to a surface of the medium 11 opposite to the print surface. The tension applying member 21 contacts the surface opposite to the print surface of the medium 11 and applies a tension to the medium 11 in the direction of the print surface of the medium 11. In this manner, the tension may be applied to the whole of the transported medium 11 in the width direction without causing damage to an object printed on the medium. There is a relatively large space available between the printing unit 15 and the take-up roller 17 in the medium transport path of the printer 10. The tension applying member 21 is disposed in this space. Then, the tension applying member 21 may be disposed in the printer 10 without having to change the arranged positions of the platen 27 and the take-up roller 17.

Figure 3:
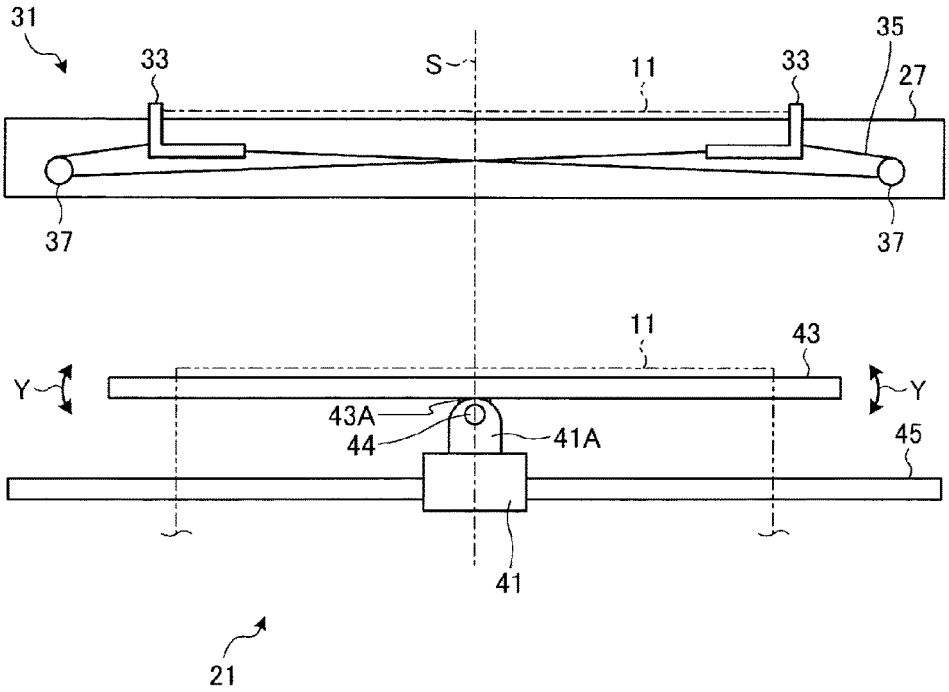
FIG. 3 is a drawing of a positional relationship between the tension applying member and a medium position regulation guide.

FIG. 3 is a drawing of a positional relationship between the tension applying member 21 and the medium position regulation guide 31. As illustrated in FIG. 3, the tension applying member 21 has a support portion 41 and an oscillation shaft 43. The support portion 41 is located on a center line S in the width direction of the medium 11 regulated by the medium position regulation guide 31 (straight line passing through the center position in the width direction of the medium 11 and extending in the transport direction of the medium 11). The oscillation shaft 43 extends in the width direction of the medium 11 and oscillates on the support portion 41 serving as fulcrum in the thickness direction of the medium 11 (direction illustrated with arrow Y in the drawing). The support portion 41 has a pair of upper and lower tongue-shaped pieces 41A on a surface thereof facing the oscillation shaft 43. These tongue-shaped pieces 41A extend toward the oscillation shaft 43. A shaft tongue-shaped piece 43A is formed at the center of the oscillation shaft 43 in a longitudinal length thereof and is pushed in between the tongue-shaped pieces 41A. The shaft tongue-shaped piece 43A and the upper and lower tongue-shaped pieces 41A are coupled to one another by a fixture such as a bolt 44. The oscillation shaft 43 extends in the width direction of the medium 11. The surface of the oscillation shaft 43 that contacts the medium 11 has a curved shape. The oscillation shaft 43 is desirably smaller in mass so as to oscillate more responsively. For that purpose, the oscillation shaft 43 may be formed in the shape of a hollowed pipe, and examples of its material may include light metals such as aluminum. The oscillation shaft 43 oscillates in the thickness direction of the medium 11 on the support portion 41 (bolt 44) serving as fulcrum. The oscillation shaft 43 is a non-rotatable member having a bar-like shape and is coupled to the support portion 41. The surface of the oscillation shaft 43 that contacts the medium 11 is smoothed to facilitate the transport of the medium 11. It should be understood that a rotatable roller may constitute the oscillation shaft 43. In this embodiment, the tension applying member 21 has a support shaft 45 at the same height as the oscillation shaft 43. The support shaft 45 supports the support portion 41 at a position more distant from the medium 11 than the oscillation shaft 43. The support shaft 45 extends in the width direction of the medium 11 orthogonal to the transport direction of the medium 11. The support shaft 45 supports the support portion 41 in a manner that the support portion 41 is slidable (movable) along the support shaft 45. The center position of the medium 11 may be variable with changes in the width of the medium 11 to be transported and/or position to which the medium 11 is transported. Yet, the support portion 41 thus supported may be easily adjusted to the center position in the width direction of the medium 11. After the position adjustment, the support portion 41 is fixed to the support shaft 45 to be immovable in the width direction of the recording medium 11. The oscillation shaft 43 is disposed at a position in vicinity of the medium position regulation guide 31 on the downstream side of the transport direction relative to the medium position regulation guide 31. The medium 11 regulated by the medium position regulation guide 31 and thereby positionally corrected is then oscillated by the oscillation shaft 43. This may effectively prevent the occurrence of skew and/or lifting of the medium 11.

As described earlier, the medium position regulation guide 31 guides the medium 11 and regulates the center position in the width direction of the medium 11 to coincide with a predetermined position. As illustrated in FIG. 3, the medium position regulation guide 31 has a pair of right and left guide pieces 33. The guide pieces 33 protrude above the surface of the platen 27 and extend along the side edge of the medium 11. The medium position regulation guide 31 further has a belt 35 and a pair of rollers 37. The belt 35 is coupled to the guide pieces 33 and laid across the rollers 37. The guide pieces 33 are disposed at positions equally spaced from a predetermined position (center line S in the width direction of the medium 11 in FIG. 3). The guide pieces 33 are coupled to the belt 35. The belt 35 is laid across the rollers 37 in a manner the number "8" is drawn. When one of the guide pieces 33 is moved by a distance away from the center line S of the medium 11, the other one of the guide pieces 33 is synchronously moved away from the center line S by the same distance. When one of the guide pieces 33 is moved by a distance toward the center line S of the medium 11, the other one of the guide pieces 33 is synchronously moved toward the center line S by the same distance. In this structure, the guide pieces 33 move to positions equally spaced from the predefined center line S. In case of any change in the width of the medium 11, therefore, adjusting the position of the support portion 41 of the tension applying member 21 may be unnecessary. This may reduce workload for printing preparations. The guide pieces 33, after having their positions decided suitably for the width of the medium 11, are fixed at the positions.

In this embodiment, description has been given of a configuration in which the movement of one of the guide pieces 33 synchronizes with the movement of the other guide piece 33. Optionally, the guide pieces may be separately adjusted in so far as the center position in the width direction of the medium 11 is regulatable. In this embodiment, the center position in the width direction of the medium 11 remains unchanged irrespective of the width of the medium 11. Instead, the center position may change with different media. In this instance, the position of the support portion 41 of the tension applying member 21 may be changed in accordance with the center position in the width direction of any medium used.

Figure 4A:
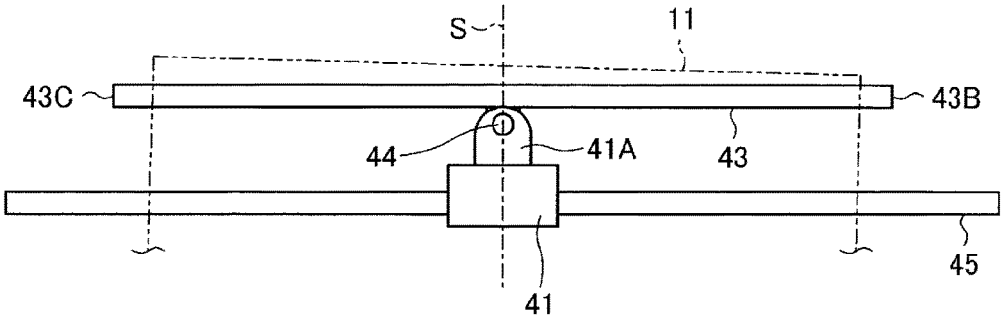
FIGS. 4A and 4B are drawings that illustrate the operation of the tension applying member.
Figure 4B:
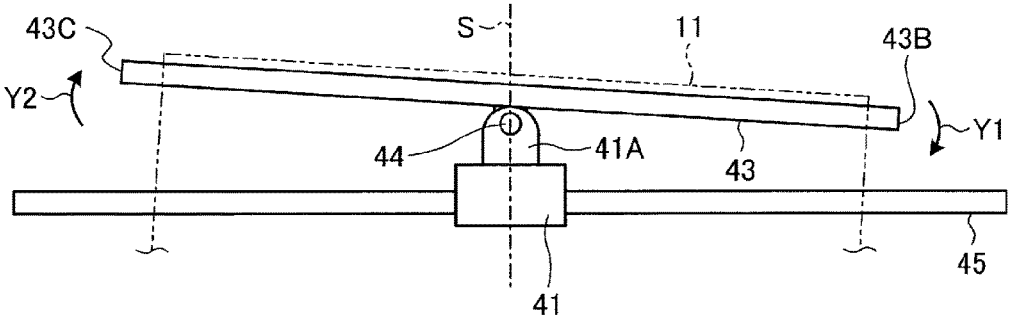

Next, the operation of the tension applying member 21 is described. The position of the support portion 41 is adjusted beforehand by the medium position regulation guide 31 so as to meet the center position in the width direction of the medium 11. FIGS. 4A and 4B are drawings that illustrate the operation of the tension applying member. FIG. 4A is a drawing of the medium 11 undergoing skew. FIG. 4B is a drawing of the oscillation shaft 43 being oscillated in response to the occurrence of skew.

As illustrated in FIG. 4A, when the tension generated on one end side of the medium 11 (axial one end 43B of the oscillation shaft 43) becomes greater than the tension generated on the other end side of the medium 11 (the other end 43C of the oscillation shaft 43) during the transport, the medium 11 may undergo skew, causing the medium 11 to lean toward the other end 43C at which the tension is smaller. In this embodiment, when different tensions are generated on one end 43B and the other end 43C of the oscillation shaft 43, the oscillation shaft 43 may oscillate on the fulcrum support portion 41 in the thickness direction of the medium 11. Specifically, the one end 43B subject to a larger tension moves toward the support shaft 45 (direction illustrated with arrow Y1 in the drawing), and the other end 43C subject to a smaller tension accordingly moves away from the support shaft 45 (direction illustrated with arrow Y2 in the drawing). The support portion 41, the oscillation center of the oscillation shaft 43, is located on the center line S in the width direction of the medium 11. Therefore, when the tensions generated on both ends of the oscillation shaft 43 are balanced against each other at a position, the oscillation stops at the position. For any difference between tensions generated on the medium 11 during the transport, the oscillation shaft 43, in response to the tension difference, may oscillate on the support portion 41 serving as fulcrum in the thickness direction of the medium 11. This may adequately absorb the tension difference, effectively preventing the occurrence of skew and/or lifting of the medium 11.

According to this embodiment, the printer includes: a feed roller 13 on which a medium 11 is wound in a roll form and from which the medium 11 is unwound and fed in a predetermined transport direction; a printing unit 15 that prints an object to be printed on the medium 11 unwound and fed from the feed roller 13; a take-up roller 17 that takes up the medium 11 printed by the printing unit 15 in a roll form; and a tension applying member 21 that applies a tension to the medium 11 by making a contact with the medium 11. The tension applying member 21 has a support portion 41 disposed at a center position in a width direction of the medium 11, and an oscillation shaft 43 extending in the width direction of the medium 11 and adapted to oscillate in contact with the medium 11 in a thickness direction of the medium 11. The oscillation shaft 43 is oscillated on the support portion 41 serving as fulcrum. In this printer, for any difference between tensions generated on one end side and the other end side in the width direction of the medium 11, the oscillation shaft 43 oscillates in a direction in which the tension difference is negated. When, for example, skew is about to occur during the transport of the medium, the oscillation shaft 43 immediately starts to oscillate, absorbing any difference between tensions generated on two lateral sides of the medium 11. As a result, the occurrence of skew and/or lifting of the medium 11 may be effectively prevented. Such a simple structure may promise steady and reliable transport of the medium 11 without the risk of the medium 11 meandering from one side to the other. The medium 11 thus transported and collected by the take-up roller 17 may effectively reduce unfavorable events such as crinkling.

According to this embodiment, the tension applying member 21 interposed between the printing unit 15 and the take-up roller 17 may allow the printed medium 11 to be reliably collected by the take-up roller 17 without the risk of the medium 11 meandering from one side to the other. This may effectively reduce unfavorable events such as crinkling of the medium 11. There is a relatively large space available between the printing unit 15 and the take-up roller 17 in the medium transport path of the printer 10. The tension applying member 21 is disposed in this space. Then, the tension applying member 21 may be disposed in the printer 10 without having to change the arranged positions of the platen 27 and the take-up roller 17.

According to this embodiment, the printer further has a medium position regulation guide 31 that regulates the medium 11 to locate at a predetermined position, and the support portion 41 is disposed on the center line S passing through the center position in the width direction of the medium 11 regulated by the medium position regulation guide 31 and extending in the transport direction of the medium 11. Therefore, the support portion 41, the oscillation fulcrum of the oscillation shaft 43 in the tension applying member 21, is always positioned at the center in the width direction of the medium 11. Any difference between tensions generated in the width direction of the medium 11 may be thereby adequately absorbed, and the occurrence of skew and/or lifting of the medium 11 may be effectively prevented.

In this embodiment, the oscillation shaft 43 is disposed in vicinity of the medium position regulation guide 31. Therefore, the occurrence of skew and/or lifting of the medium 11 may be effectively prevented. The oscillation shaft 43 is disposed at a position on the downstream side in the transport direction relative to the medium position regulation guide 31. By having the medium 11 oscillated by the oscillation shaft 43 after the medium 11 is regulated by the medium position regulation guide 31 and thereby positionally corrected, the occurrence of skew and/or lifting of the medium 11 may be effectively prevented.

In this embodiment, the tension applying member 21 has a support shaft 45 extending in a direction orthogonal to the transport direction of the medium 11, and the support portion 41 is slidable on the support shaft 45. Therefore, the position of the support portion 41 may be suitably changed in accordance with the center position in the width direction of the medium 11. When media 11 having different widths are transported, any one of the media 11 may be readily and reliably collected by the take-up roller 17 and thereby prevented from undergoing unfavorable events such as crinkling.

Description has been given of the embodiment of this invention. The embodiment, however, is a non-limiting example of this invention, which is not intended to limit the technical scope of this invention. The described embodiment may be carried out in many other suitable forms. It should be understood that the technical features described in the embodiment may be optionally omitted, replaced, or changed within the scope and true spirit of this invention. While there has been described what is at present considered to be an embodiment of this invention, it should be understood that the embodiment and various modifications thereof fall within the true spirit and scope of this invention, as well as within the scope of the appended claims and equivalents thereof.

In the embodiment, an example is described in which the tension applying member 21 is disposed at a position between the printing unit 15 and the take-up roller 17. However, if the printer 10 has enough space, the tension applying member 21 may be interposed at a position between the feed roller 13 and the take-up roller 17, such as a position between the feed roller 13 and the platen 27.

What is claimed is:

1. A printer comprising:

a feed roller on which a medium with an elongated shape is wound in a roll form and from which the medium is unwound and fed in a predetermined transport direction;

a printing unit that prints an object to be printed on the medium fed from the feed roller;

a take-up roller that takes up the medium printed by the printing unit in a roll form; and a tension applying member that applies a tension to the medium by making a contact with the medium, the tension applying member including:

a support portion disposed at a center position in a width direction of the medium, wherein the support portion is movable in a direction orthogonal to the transport direction of the medium and is located on a straight line extending in the transport direction; and an oscillation shaft extending in the width direction of the medium and adapted to oscillate in contact with the medium in a thickness direction of the medium, the oscillation shaft being oscillated on the support portion serving as fulcrum.

2. The printer as set forth in claim 1, wherein the tension applying member is disposed at a position between the feed roller and the take-up roller.

3. The printer as set forth in claim 1, further comprising a medium position regulation guide that regulates the medium to locate at a predetermined position in the width direction, wherein:

the support portion is disposed on a straight line passing through the center position in the width direction of the medium regulated by the medium position regulation guide and extending in the transport direction of the medium.

4. The printer as set forth in claim 3, wherein the oscillation shaft is disposed in vicinity of the medium position regulation guide.

5. The printer as set forth in claim 3, wherein the oscillation shaft is disposed at a position on a downstream side in the transport direction relative to the medium position regulation guide.

* * * * *